US005974763A

United States Patent [19]

Colson et al.

[11] Patent Number: 5,974,763

[45] Date of Patent: Nov. 2, 1999

[54] CELL-INSIDE-A-CELL HONEYCOMB MATERIAL

[75] Inventors: Wendell B. Colson, Westin, Mass.; Paul G. Swiszcz, Boulder; Jason T. Throne, Steamboat Springs, both of Colo.

[73] Assignee: Hunter Douglas Inc., Upper Saddle River, N.J.

[21] Appl. No.: 09/012,357

[22] Filed: Jan. 23, 1998

[51] Int. Cl.[6] ..... E06B 9/24

[52] U.S. Cl. ..... 52/793.1; 52/309.1; 52/793.11; 160/84.05; 428/12; 428/73; 428/118; 428/188

[58] Field of Search ..... 52/2.24, 309.1, 52/793.1, 793.11; 160/84.05; 428/12, 73, 118, 188

[56] References Cited

U.S. PATENT DOCUMENTS 4,450,027 5/1984 Colson .
4,603,072 7/1986 Colson .
4,631,108 12/1986 Colson .
4,795,515 1/1989 Kao et al. .
4,871,006 10/1989 Kao et al. .
5,482,750 1/1996 Colson et al. .
5,837,084 11/1998 Barss ..... 160/84.05 X
B1 5,228,936 6/1996 Goodhue .

*Primary Examiner*—Christopher T. Kent
*Attorney, Agent, or Firm*—Dorsey & Whitney LLP

[57] ABSTRACT

A honeycomb insulating panel is described wherein each cell of the panel has multiple layers of material formed by embedding tubular cells. In this manner, a retractable cover for an architectural opening may be formed that has superior insulating or light blocking capabilities in a volume comparable to a honeycomb panel made of tubular cells having a single layer of material. The resultant panel is formed by attaching a plurality of embedded tubular cell units, wherein each embedded tubular cell unit comprises at least one side having multiple layers of material.

19 Claims, 7 Drawing Sheets

CELL-INSIDE-A-CELL HONEYCOMB MATERIAL

BACKGROUND OF THE INVENTION a. Field of the Invention

The instant invention is directed toward expandable and collapsible honeycomb panels. More specifically, it relates to a honeycomb panel where at least one of the elongated tubular cells comprising the collapsible honeycomb panel is itself multi-cellular.

b. Background Art

It is well known that cellular panels provide excellent coverings for architectural openings. For example, U.S. Pat. No. 5,482,750 discloses a multi-cellular honeycomb insulating panel. Another type of retractable cellular panel is disclosed in U.S. Pat. No. 4,603,072, the disclosure of which is hereby incorporated by reference. Still another type of honeycomb insulating panel is disclosed in U.S. Pat. Nos. 4,795,515 and 4,871,006. In the '515 and '006 patents, a plurality of attaching strips join two sheets of fabric along corresponding pleat lines formed in each of the two sheets. U.S. Pat. No. 5,228,936 discloses yet another insulating panel wherein a strip connects adjacent sheets of fabric.

Various machines are known that are capable of manufacturing cellular panels at high speeds. For example, U.S. Pat. No. 4,450,027, the disclosure of which is hereby incorporated by reference, discloses an apparatus for manufacturing cellular panels. Related U.S. Pat. No. 4,631,108, the disclosure of which is hereby incorporated by reference, issued from a continuation-in-part of the application that eventually issued as the '027 patent.

Cellular honeycomb panels have been manufactured heretofore having multiple cells juxtaposed such that in order to pass through the honeycomb panel along a path that is perpendicular to the plane of the panel one must pass through more than one cell. A panel of this type is disclosed in the '750 patent mentioned above. These panels have excellent insulating properties, but may be rather thick.

SUMMARY OF THE INVENTION

It is desirable, therefore, to be able to form a multi-cellular honeycomb insulating panel wherein more than one tubular cell is encountered while passing perpendicularly through the panel, and further wherein the overall thickness of the panel is comparable to the thickness of a honeycomb insulating panel that is a single tubular cell thick.

Accordingly, it is an object of the disclosed invention to provide an improved retractable cover for an architectural opening.

The instant invention is an expandable and contractible honeycomb panel comprising a plurality of adjacent, embedded tubular cell units affixed together one on top of another. Each of these embedded tubular cells has a front side and a rear side, and is constructed of at least one strip of foldable and creasable material. Further, at least one of the front side and the rear side of each embedded tubular cell is composed of multiple layers of material.

A more detailed explanation of the invention is provided in the following description and claims and is illustrated in the accompanying drawings.

DESCRIPTION OF THE PREFERRED EMBODIMENTS

Several embodiments of a cellular panel 10, comprising a plurality of elongated, embedded tubular cell units 12, each cell unit having at least one wall comprising at least two layers of material are disclosed. An advantage of this invention is that it provides enhanced insulation in the same dimension as a single-cell product. The multi-layered wall or walls of the instant invention also provide improved light control, which can be even further enhanced by including a black-out material as one or more of the layers of the walls. Another advantage of the disclosed invention is that the multi-layered walls of the disclosed embedded tubular cell units demonstrate enhanced pleat retention.

Figure 1:
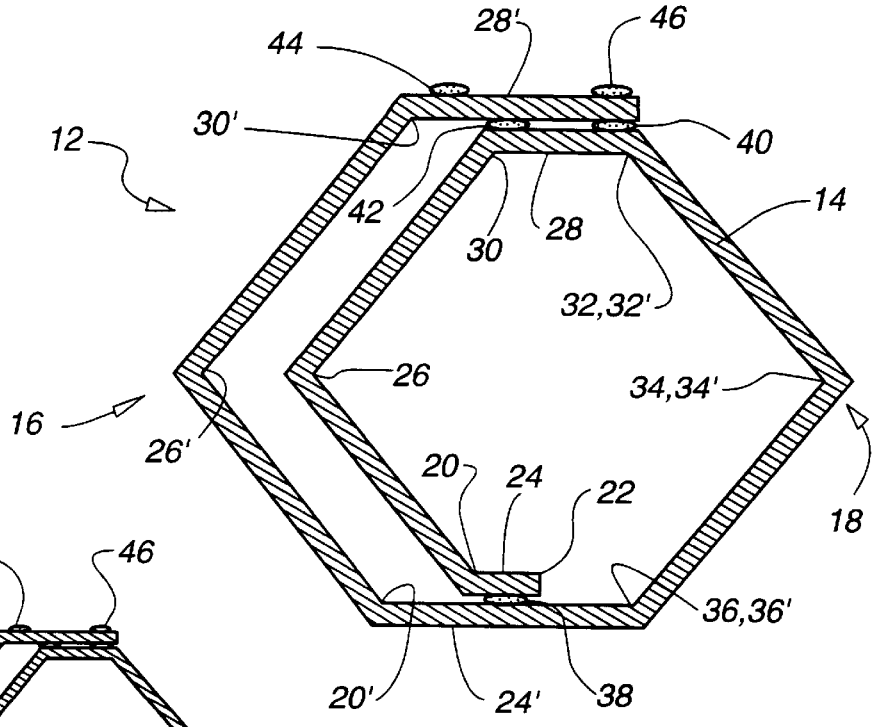
FIG. 1 is a cross-sectional view of an elongated tubular cell used to form a honeycomb panel according to a first embodiment of the instant invention.
Figure 2:
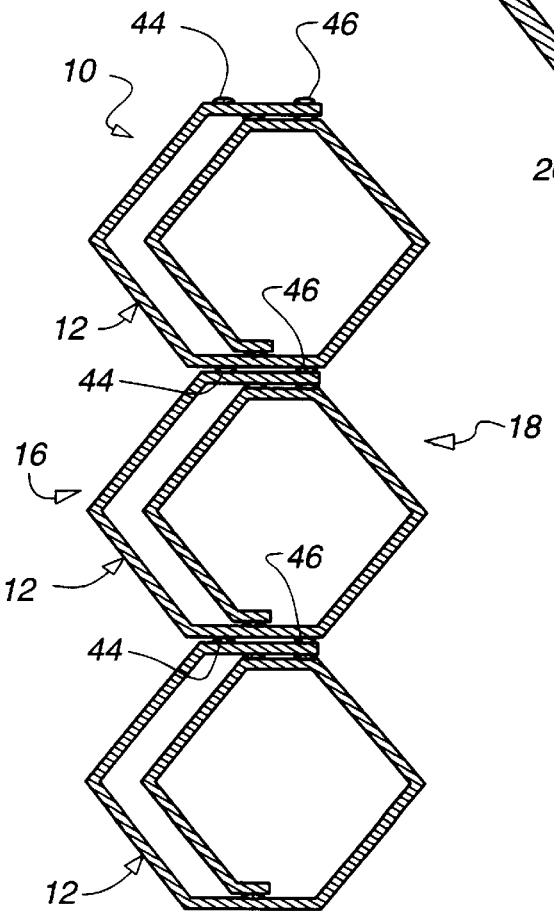
FIG. 2 is a cross-sectional view of a plurality of elongated tubular cells according to FIG. 1.
Figure 3:
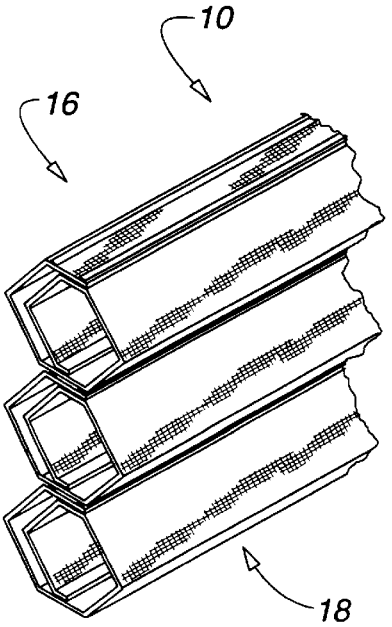
FIG. 3 is a perspective view of a portion of a honeycomb panel formed using elongated tubular cells according to FIG. 1.

Referring first to FIGS. 1 through 3, a first embodiment of the invention shall be described. FIG. 1 is a cross-sectional view of an embedded tubular cell unit 12 according to a first embodiment of the present invention. In this embodiment, a single strip of foldable and creasable material 14 is folded inside itself. The foldable and creasable material 14 may be made of plastic, Mylar®, polyester, or some other thin film material that is preferably capable of retaining a crease. Alternatively, it may be a knit, woven, or non-woven material such as a spunbonded polyester. By folding the strip of material 14 inside itself, an embedded tubular cell unit 12 is thereby formed. The resulting tubular cell unit 12 has a front side 16 and a rear side 18.

Forming the embedded tubular cell unit 12 requires completion of a series of folding and gluing steps. In the embodiment depicted in FIG. 1, a first subordinate crease 20 is formed in the strip of material 14 proximate to a first free-end portion 22 of the strip 14. In this embodiment, the material between the first subordinate crease 20 and the first free-end portion 22 is referred to as the first portion 24. Moving clockwise in FIG. 1 along the material 14 from the first free-end portion 22, the first main crease or fold 26 is encountered next. This first main crease 26 is the primary divider between the first portion 24 and the second portion 28 along the front side 16 of the interior tubular cell. Continuing clockwise along the material 14 from the first main crease 26, the second subordinate crease 30 is next encountered. A third subordinate crease 32 is next encountered, thereby defining the second portion 28 between the second subordinate crease 30 and the third subordinate crease 32. This third subordinate crease 32 of the interior tubular cell also comprises the third subordinate crease 32' of the exterior tubular cell, which is further discussed below. Continuing clockwise along the material 14 from the third subordinate crease 32 (or 32'), the second main crease or fold 34 is next encountered. This second main crease or fold 34 of the interior tubular cell also comprises the second main crease or fold 34' of the exterior tubular cell as further discussed below. The second main crease 34 (or 34') is the primary divider along the rear side 18 between the second portion 28 of the interior tubular cell and the first portion 24' of the exterior tubular cell. Continuing clockwise from the second main crease 34 (or 34') along the material 14, a fourth subordinate crease 36 is next encountered. This fourth subordinate crease 36 of the interior tubular cell also comprises the fourth subordinate crease 36' of the exterior tubular cell as further discussed below. The interior tubular cells thus comprise four subordinate creases 20, 30, 32, 36 and two main creases 26, 34.

The exterior tubular cell similarly comprises four subordinate creases 20', 30', 32', 36' and two main creases 26', 34'. In this first embodiment, the third and fourth subordinate creases 32, 36, respectively, and the second main crease 34 of the interior tubular cell are the same as the third and fourth subordinate creases 32', 36', respectively, and the second main crease 34' of the exterior tubular cell. Thus, in the first embodiment, as best depicted in FIGS. 1 and 2, only the front side 16 of each embedded tubular cell unit 12 comprises multiple layers. In this embodiment, the rear side 18 of the two embedded cells comprises the same section of the strip of material 14.

It is the first and second main creases 26, 34 (or 26', 34'), respectively, that are primarily responsible for giving the resulting embedded tubular cell unit 12 its overall cellular shape. This is true for each tubular cell of the family of neighboring tubular cells comprising each embedded tubular cell unit 12. The first and second main creases 26, 34 (or 26', 34') tend to bias the first portion 24 (or 24') toward the second portion 28 (or 28') of each tubular cell comprising an embedded tubular cell unit 12. Although the discussion of this first embodiment and of the other embodiments refers to "pleats" or "creases," the instant invention does not require them. Pleats or creases may be beneficial for some uses of the invention and are used in this disclosure for illustrative purposes, but are not required and need not be severe or well-defined.

In the first embodiment, FIGS. 1 through 3, the outer surface of the first portion 24 of the interior tubular cell is affixed to the inner surface of the first portion 24' of the exterior tubular cell by an adhesive bead 38. Clearly, more than one adhesive bead could be used in place of the single adhesive bead 38 depicted. The adhesive used to affix the various parts of an embedded tubular cell unit 12 may be, for example, heat activated or some other type of adhesive, or two-sided tape. An acceptable type of adhesive is aliphatic adhesive. The outer surface of the second portion 28 of the interior tubular cell, if affixed, is affixed to the inner surface of the second portion 28' of the exterior tubular cell by adhesive beads 40 and 42.

Referring now to FIGS. 2 and 3, a honeycomb panel 10 is formed by affixing adjacent embedded tubular cell units 12, each of which has been formed as described above. Adjacent embedded tubular cell units 12 are affixed with adhesive beads 44 and 46. When the outer surfaces of adjacent embedded tubular cell units 12 are thus adhered with adhesive beads 44, 46, a honeycomb insulating panel 10, having a multi-layered front side 16 and a single-layered rear side 18 is thereby formed.

The size of the resulting honeycomb panel 10 is a function of the cross-sectional size of each embedded tubular cell unit 12, the number of embedded tubular cell units 12 affixed to form the honeycomb panel 10, and the length of each embedded tubular cell unit 12 along its longitudinal axis. When the resultant honeycomb panel 10 (FIG. 3) is designed to expand and contract vertically, the length of each embedded tubular cell unit 12 defines the width of the resultant panel 10. The height of the panel 10 is a function of both the height of each embedded tubular cell unit 12 (i.e., the distance between the first portion 24' and the second portion 28' of the exterior tubular cell) and the number of embedded tubular cell units 12 affixed together to form the honeycomb panel 10.

Figure 4:
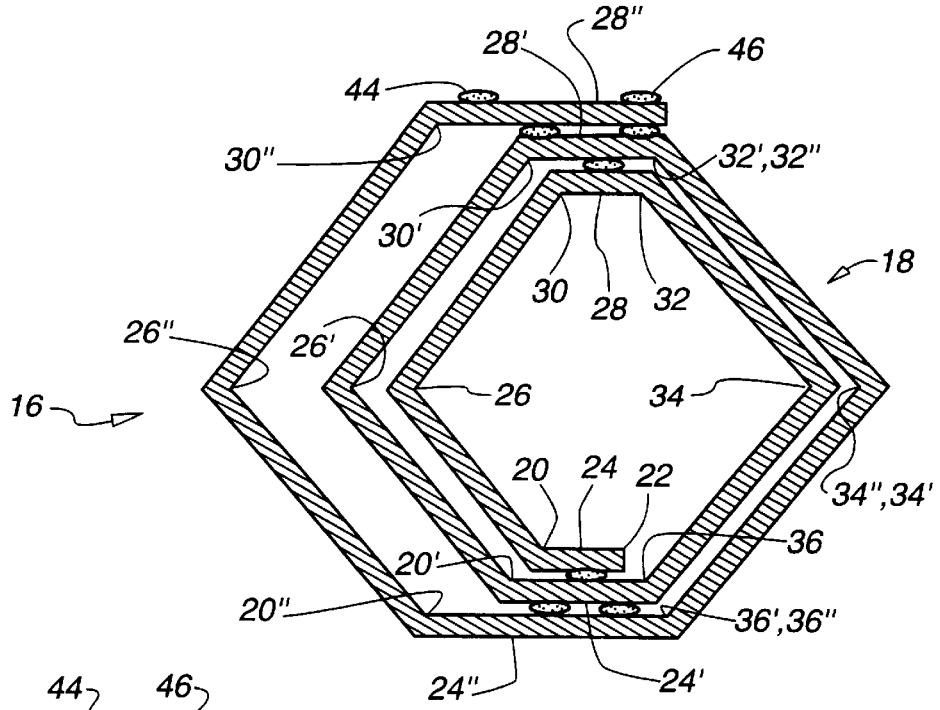
FIG. 4 is a cross-sectional view of an elongated tubular cell used to form a honeycomb panel according to a second embodiment of the instant invention.
Figure 5:
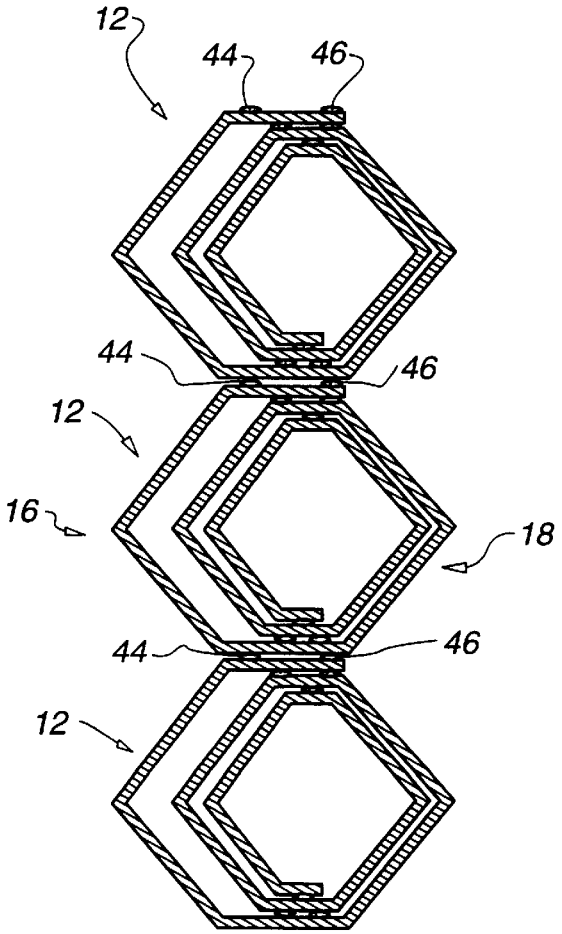
FIG. 5 is a cross-sectional view of a plurality of elongated tubular cells according to FIG. 4.
Figure 6:
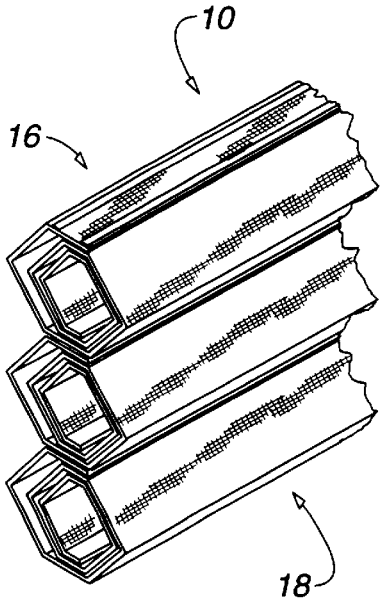
FIG. 6 is a perspective view of a portion of a honeycomb panel formed using elongated tubular cells according to FIG. 4.

Referring now to FIGS. 4 through 6, a second embodiment of the instant invention is described. In this embodiment, the front side 16 of the resultant honeycomb panel 10 comprises three layers of material, and the rear side 18 comprises two layers of material. In this embodiment, the honeycomb panel 10 comprises embedded tubular cell units 12 that each comprise a family of three neighboring tubular cells. Each family member comprises four subordinate creases, for example, 20, 30, 32, 36, and two main creases, for example, 26, 34. The second main crease 34" of the exterior tubular cell also comprises the main crease 34' of the intermediate tubular cell.

Figure 7:
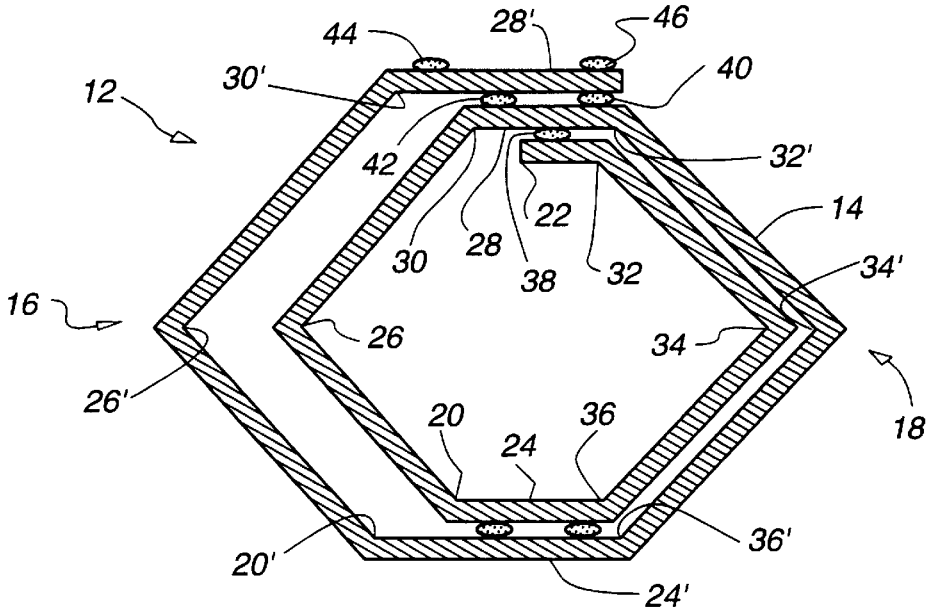
FIG. 7 is a cross-sectional view of an elongated tubular cell used to form a honeycomb panel according to a third embodiment of the instant invention.
Figure 8:
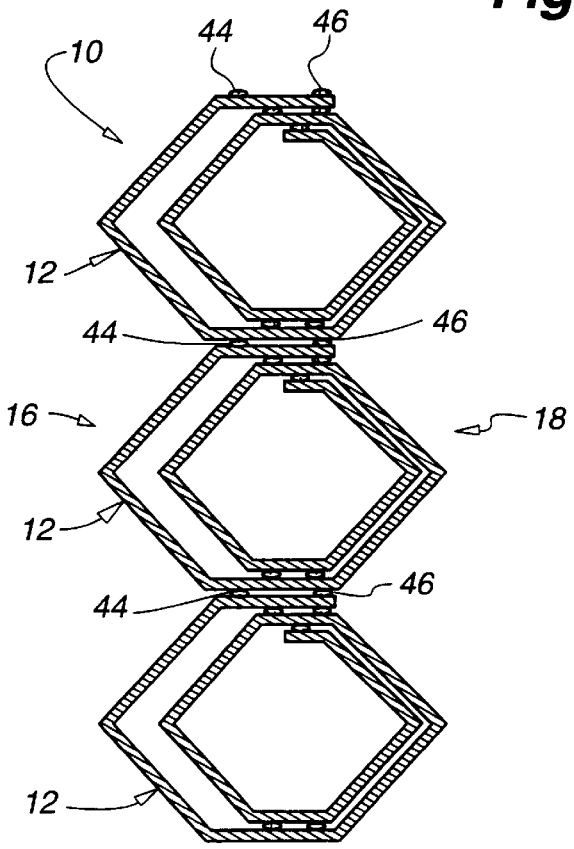
FIG. 8 is a cross-sectional view of a plurality of elongated tubular cells according to FIG. 7.
Figure 9:
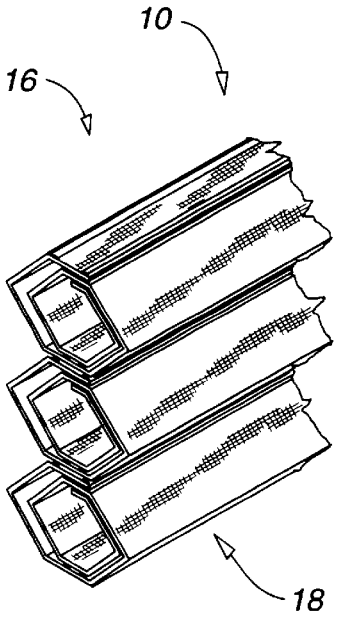
FIG. 9 is a perspective view of a portion of a honeycomb panel formed using elongated tubular cells according to FIG. 7.
Figure 10:
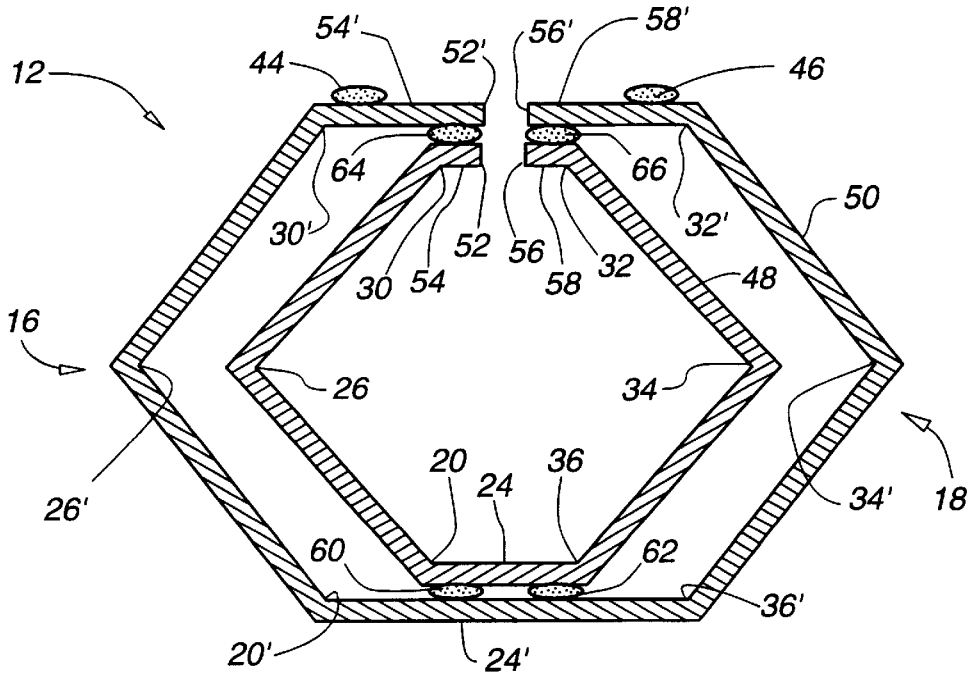
FIG. 10 is a cross-sectional view of an elongated precursor tubular cell used to form a honeycomb panel according to a fourth embodiment of the instant invention.

In both the second embodiment depicted in FIG. 4, as well as in the first embodiment depicted in FIG. 1, the outer surface of the first free-end portion 22 could be attached to the inner surface of the second portion 28 of the interior tubular cell. If this were done in the first embodiment (FIGS. 1–3), for example, and the outer surface of the first free-end portion 22 were attached to the inner surface of the second portion 28 of the interior tubular cell by an adhesive bead 38, both the front side 16 and the rear side 18 would comprise two layers of material, forming a third embodiment (see FIGS. 7–9). If this were done in the second embodiment (FIGS. 4–6), for example, both the front side 16 and the rear side 18 would comprise three layers of material.

After reviewing the embodiments of FIG. 1 through FIG. 9, one of ordinary skill in the art could adjust the number of layers on the front side 16 and rear side 18 by changing how many times and how far the strip of material 14 is folded inside itself. For example, by folding the strip of material 14 inside itself one more time in an embodiment like those depicted in FIGS. 4–6, a resultant cellular panel 10 would have four layers on the front side 16 and three layers on the rear side 18.

Referring now to FIGS. 10 through 13, a fourth embodiment of the instant invention is discussed. In the fourth embodiment, first and second strips of material 48, 50, respectively, are folded one inside another. The embodiment of FIG. 10 comprises a first strip of material 48 folded into an interior precursor tubular cell, which is then embedded in an exterior precursor tubular cell formed from the second strip of material 50. The resulting embedded precursor tubular cell unit 12 may, before it is adhered to a next adjacent embedded precursor tubular cell unit 12 of a honeycomb panel 10, be opened along the first and second inside edges (e.g., 52, 56 and 52', 56') of each embedded precursor tubular cell, revealing the interior of the embedded tubular cell unit 12; hence the adjective "precursor."

In the fourth embodiment, the innermost cell is formed of the first strip of material 48 and comprises four subordinate creases 20, 30, 32, 36 and two main creases 26, 34. In between the first subordinate crease 20 and the fourth subordinate crease 36, along the bottom of the interior precursor tubular cell, is its first portion 24. Between the second subordinate crease 30 and the first inside edge 52 is a front second portion 54. Similarly, between the third subordinate crease 32 and the second inside edge 56 lies a rear second portion 58. As may be seen clearly in FIGS. 10 and 11, the inside edges 52, 56 of the front and rear second portions 54, 58, respectively, approach one another, but do not overlap, in this embodiment. The exterior precursor tubular cell also comprises four subordinate creases 20', 30', 32', 36' and two main creases 26', 34'. In addition, the exterior precursor tubular cell has a front second portion 54', a rear second portion 58', and first and second inside edges 52', 56', respectively.

In this embodiment the outer surface of the first portion 24 of the interior precursor tubular cell is affixed to the inner surface of the first portion 24' of the exterior precursor tubular cell by adhesive beads 60, 62. As previously mentioned, any number of adhesive beads could be used to join the two precursor tubular cells to form the resultant embedded precursor tubular cell unit 12. The outer surface of the front second portion 54 of the interior precursor tubular cell is affixed by adhesive bead 64 to the inner surface of the front second portion 54' of the exterior precursor tubular cell adjacent the first inside edges 52, 52' of the interior and exterior precursor tubular cells, respectively. Similarly, the outer surface of the rear second portion 58 of the interior precursor tubular cell is affixed by adhesive bead 66 to the inner surface of the rear second portion 58' of the exterior precursor tubular cell adjacent the second inside edges 56, 56' of the interior and exterior precursor tubular cells, respectively. In the fourth embodiment, therefore, both the front side 16 and the rear side 18 of the resulting embedded precursor tubular cell unit 12 comprise two layers of material.

Figure 11:
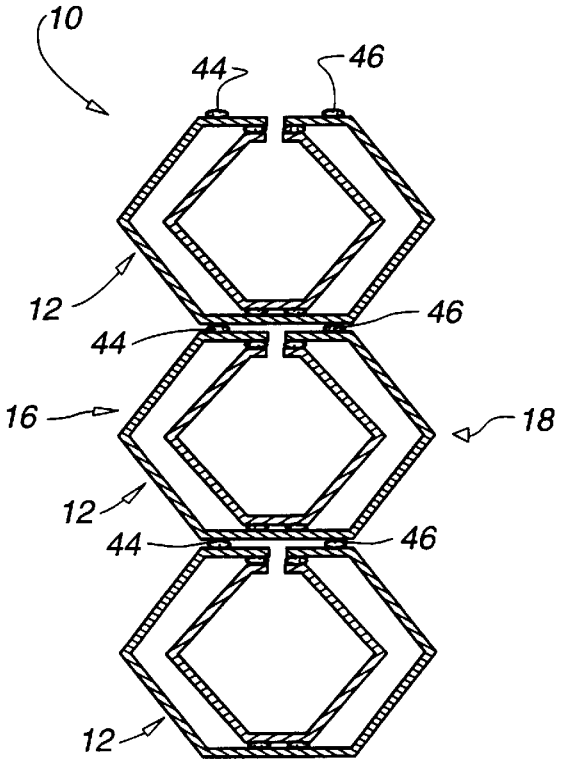
FIG. 11 is a cross-sectional view of a plurality of elongated precursor tubular cells according to FIG. 10.
Figure 12:
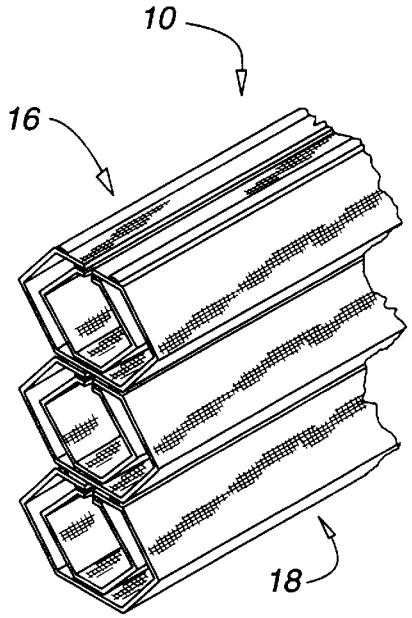
FIG. 12 is a perspective view of a portion of a honeycomb panel formed using elongated precursor tubular cells according to FIG. 10.
Figure 13:
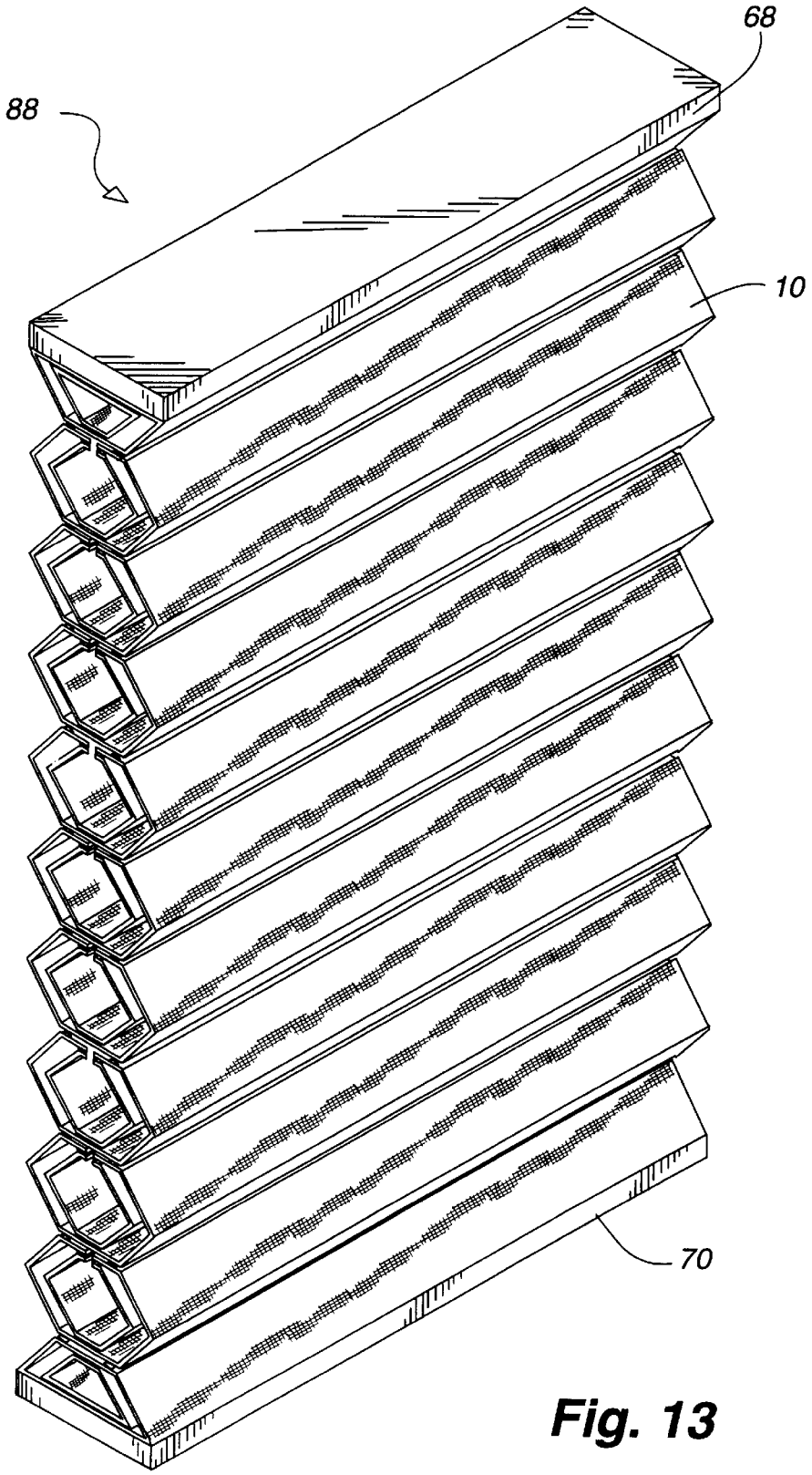
FIG. 13 is a perspective view of a retractable cover for an architectural opening incorporating a honeycomb panel formed using elongated precursor tubular cells according to FIG. 10.

Referring to FIGS. 11 and 12, a honeycomb panel 10 is formed by affixing a plurality of embedded precursor tubular cell units 12 to one another. In this embodiment, adhesive beads 44, 46 are applied to the outer surface of the front second portion 54' and the rear second portion 58', respectively, of the exterior precursor tubular cell of each embedded precursor tubular cell unit 12 to be joined to form a honeycomb panel 10. Subsequently, two adjacent embedded precursor tubular cell units 12 are aligned one on top of another and pressed together such that the adhesive beads 44, 46 on the first and second portions 54', 58' of one embedded precursor tubular cell unit 12 adhere to the outer surface of the first portion 24' of a next adjacent embedded precursor tubular cell unit 12. After a stack of embedded precursor tubular cell units 12 have been thus affixed together, resulting in a honeycomb insulating panel 10 of the desired size, a rigid top slat 68 (FIG. 13) may be adhered to the top tubular cell, and a rigid bottom slat 70 may be adhered to the bottom tubular cell. FIG. 13 depicts a complete retractable cover 88 ready to be affixed over an architectural opening.

Figure 14:
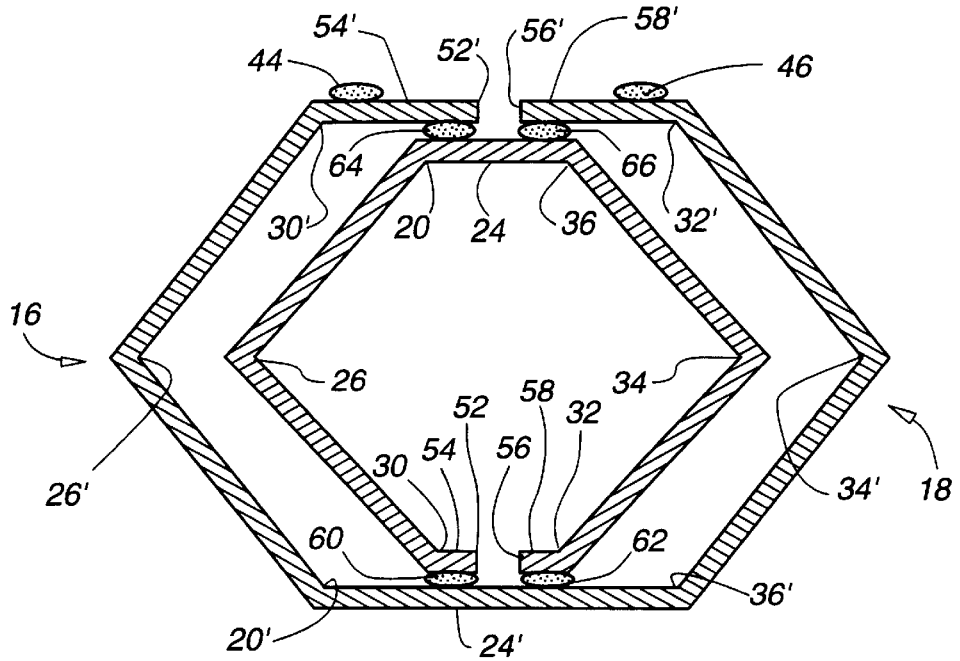
FIG. 14 is a cross-sectional view of an elongated tubular cell used to form a honeycomb panel according to a fifth embodiment of the instant invention.
Figure 15:
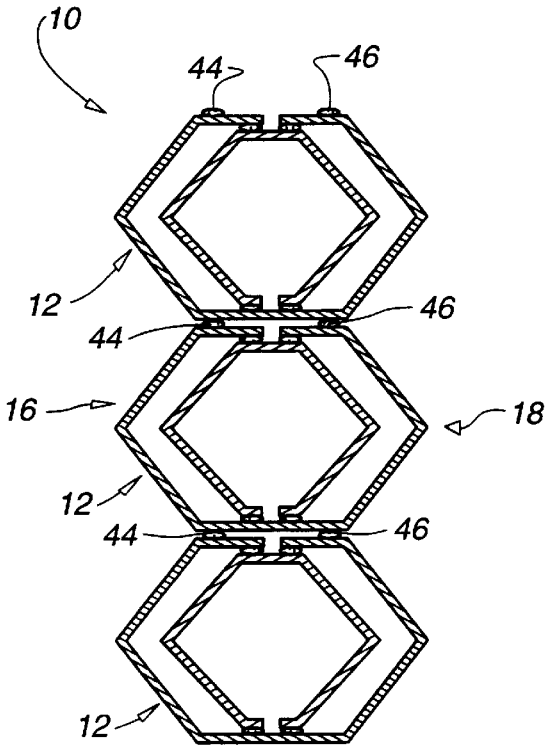
FIG. 15 is a cross-sectional view of a plurality of elongated tubular cells according to FIG. 14.
Figure 16:
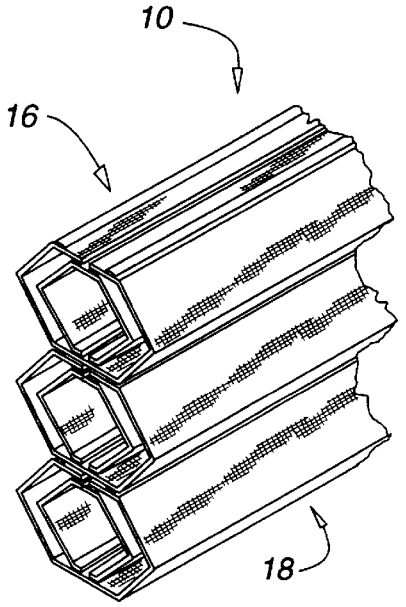
FIG. 16 is a perspective view of a portion of a honeycomb panel formed using elongated tubular cells according to FIG. 14.

Referring now to FIGS. 14 through 16, a fifth embodiment is discussed. This embodiment is most similar to the fourth embodiment just discussed. In the fifth embodiment, however, the first portion 24 of the interior precursor tubular cell is neighboring the front and rear second portions 54', 58' of the exterior precursor tubular cell. Similarly, the front and rear second portions 54, 58 of the interior precursor tubular cell are neighboring the first portion 24' of the exterior precursor tubular cell. In other words, the interior precursor tubular cell is rotated 180 degrees about its longitudinal axis relative to the exterior precursor tubular cell. This differs from the fourth embodiment, depicted in FIGS. 10 through 13, wherein the first portion 24 of one neighboring family member is affixed to the first portion 24' of a next neighboring family member. It is clear from FIG. 14, that in the fifth embodiment, the inner surface of the front second portion 54' of the exterior precursor tubular cell is affixed by adhesive bead 64 to the outer surface of the first portion 24 of the interior precursor tubular cell adjacent the first subordinate crease 20 of the interior precursor tubular cell and adjacent the first inside edge 52' of the exterior precursor tubular cell. Likewise, the inner surface of the rear second portion 58' of the exterior precursor tubular cell is affixed by adhesive bead 66 to the outer surface of the first portion 24 of the interior precursor tubular cell adjacent the fourth subordinate crease 36 of the interior precursor tubular cell and adjacent the second inside edge 56' of the exterior precursor tubular cell. Looking at the bottom portion of FIG. 14, the outer surface of the front second portion 54 of the interior precursor tubular cell is affixed by adhesive bead 60 to the inner surface of the first portion 24' of the exterior precursor tubular cell. Similarly, the outer surface of the rear second portion 58 of the interior precursor tubular cell is affixed by adhesive bead 62 to the inner surface of the first portion 24' of the exterior precursor tubular cell. Adhesive bead 60 is adjacent first inside edge 52 of the interior precursor tubular cell, and adhesive bead 62 is adjacent the second inside edge 56 of the interior precursor tubular cell.

Figure 17:
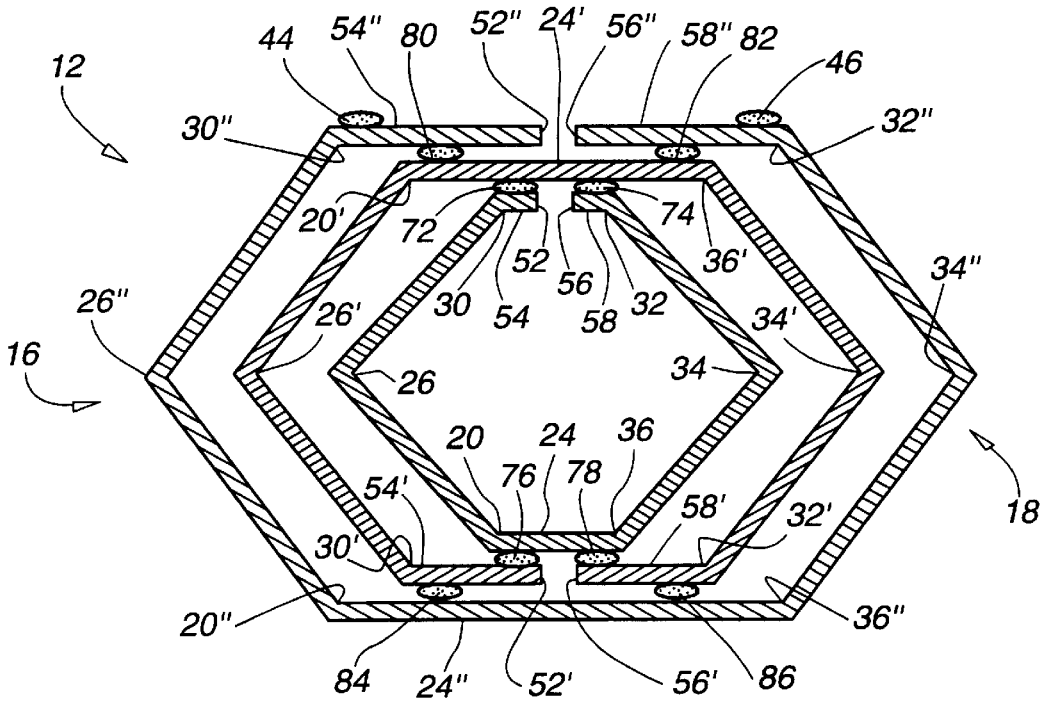
FIG. 17 is a cross-sectional view of an elongated tubular cell used to form a honeycomb panel according to a sixth embodiment of the instant invention.
Figure 18:
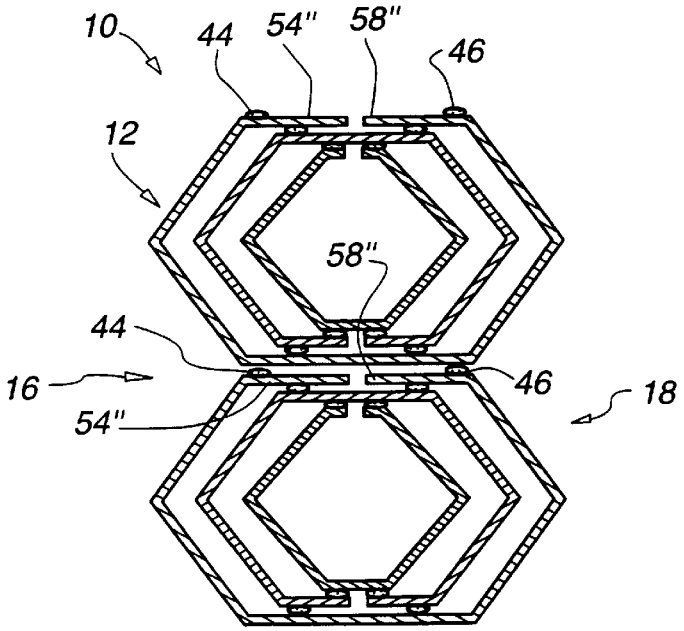
FIG. 18 is a cross-sectional view of a plurality of elongated tubular cells according to FIG. 17.
Figure 19:
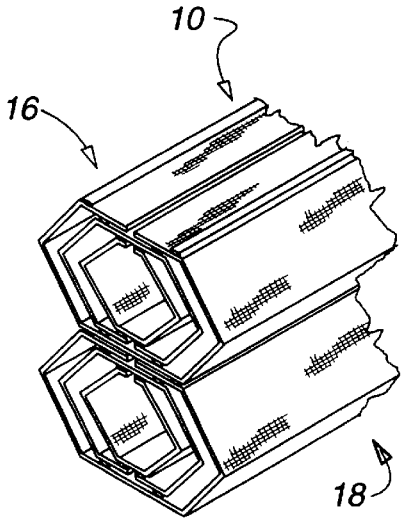
FIG. 19 is a perspective view of a portion of a honeycomb panel formed using elongated tubular cells according to FIG. 17.

Referring now to FIGS. 17 through 19, a sixth embodiment of the instant invention is discussed. In this sixth embodiment, the family of neighboring precursor tubular cells comprising an embedded tubular cell unit 12 consists of three members: an interior precursor tubular cell, an intermediate precursor tubular cell, and an exterior precursor tubular cell. Similar to the arrangement of the neighboring family members in the fifth embodiment of FIGS. 14 through 16, the neighboring family members in the sixth embodiment are not each aligned with the same orientation about their longitudinal axes. For example, the interior precursor tubular cell is oriented with its front and rear second portions 54, 58 neighboring the first portion 24' of the intermediate precursor tubular cell. Similarly, the front and rear second portions 54", 58" of the exterior precursor tubular cell are neighboring the first portion 24' of the intermediate precursor tubular cell. Thus, just as was the case in the fifth embodiment, in the sixth embodiment, each precursor tubular cell in an embedded tubular cell unit 12 is rotated 180 degrees about its longitudinal axis relative to its next neighboring cell or cells within the same family of neighboring precursor tubular cells comprising a single embedded tubular cell unit 12.

Referring now to FIG. 17, the construction of the three-member, embedded tubular cell unit 12 of the sixth embodiment is discussed. The interior precursor tubular cell is affixed to the intermediate precursor tubular cell. The intermediate precursor tubular cell is affixed to both the interior precursor tubular cell and the exterior precursor tubular cell. In the sixth embodiment the interior precursor tubular cell is affixed to the intermediate precursor tubular cell by four adhesive beads 72, 74, 76, 78. Adhesive bead 72 adheres the outer surface of the front second portion 54 of the interior precursor tubular cell to the inner surface of the first portion 24' of the intermediate precursor tubular cell. Similarly, adhesive bead 74 adheres the outer surface of the rear second portion 58 of the interior precursor tubular cell to the inner surface of the first portion 24' of the intermediate precursor tubular cell. Adhesive bead 76 adheres the outer surface of the first portion 24 of the interior precursor tubular cell to the inner surface of the front second portion 54' of the intermediate precursor tubular cell adjacent the first inside edge 52' of the intermediate precursor tubular cell. Adhesive bead 78 adheres the outer surface of the first portion 24 of the interior precursor tubular cell to the inner surface of the rear second portion 58' of the intermediate precursor tubular cell adjacent the second inside edge 56' of the intermediate precursor tubular cell.

The combination of the interior precursor tubular cell and the intermediate precursor tubular cell is next affixed to the exterior precursor tubular cell by adhesive beads 80, 82, 84, 86. Adhesive bead 80 adheres the outer surface of the first portion 24' of the intermediate precursor tubular cell to the inner surface of the front second portion 54" of the exterior precursor tubular cell. Similarly, adhesive bead 82 adheres the outer surface of the first portion 24' of the intermediate precursor tubular cell to the inner surface of the rear second portion 58" of the exterior precursor tubular cell. Adhesive bead 84 adheres the outer surface of the front second portion 54' of the intermediate precursor tubular cell to the inner surface of the first portion 24" of the exterior precursor tubular cell. Finally, adhesive bead 86 adheres the outer surface of the rear second portion 58' of the intermediate precursor tubular cell to the inner surface of the first portion 24" of the exterior precursor tubular cell. The resultant embedded tubular cell unit 12 has three layers of material on both its front side 16 and its rear side 18.

Referring now to FIGS. 18 and 19, a honeycomb insulating panel 10 is depicted that has been made by adhering together embedded tubular cell units 12 according to the sixth embodiment. The cellular panel 10 depicted in FIGS. 18 and 19 is formed by adhering adjacent embedded tubular cell units 12 to each other with adhesive beads 44, 46. For example, referring to FIG. 18, adhesive bead 44 is applied to the outer surface of the exterior precursor tubular cell of the bottom embedded tubular cell unit 12 near its front second portion 54". Adhesive bead 46 is applied to the outer surface of the exterior precursor tubular cell of the same bottom embedded tubular cell unit 12 near its rear second portion 58". With beads 44 and 46 in place, the outer surface of the first portion 24" of the exterior precursor tubular cell of the top embedded tubular cell unit 12 in FIG. 18 is then pressed against the adhesive beads 44 and 46 of the bottom embedded tubular cell unit 12. Although only two embedded tubular cell units 12 are joined in the honeycomb insulating panel 10 depicted in FIGS. 18 and 19, any number of embedded tubular cell units 12 could be affixed together to create a honeycomb panel 10 of any desired size.

In the fifth embodiment (FIGS. 14–16) and sixth embodiment (FIGS. 17–19), an individual embedded tubular cell units 12 may not be opened to reveal its interior, even before it is affixed to an adjacent embedded tubular cell units 12 to form a resultant honeycomb insulating panel 10. The alternating configuration of these embodiments, wherein the orientation of each tubular cell in the embedded tubular cell unit 12 is rotated 180 degrees about its longitudinal axis in relation to its neighbor or neighbors, prevents being able to open the embedded tubular cell unit 12 along a line parallel to its longitudinal axis. In other words, in the fifth and sixth embodiments, every other tubular cell of a particular family of neighboring embedded tubular cells is rotated 180 degrees about its longitudinal axis. This provides additional structural integrity to each individual embedded tubular cell unit 12.

Although six embodiments of this invention have been described above, it will be apparent to those skilled in the art that numerous alterations may be made without departing from the spirit or scope of this invention. For example, the single strip of material 14 that is rolled inside itself to form the embedded tubular cell units 12 of the first, second, and third embodiments could be rolled inside itself any number of times to provide the desired light blocking or insulating capabilities. Similarly, the number of tubular cells in a family of neighboring tubular cells comprising an embedded tubular cell unit 12 can be altered to achieve desired light blocking or insulating capabilities. An important feature of this invention is that a multi-layered cellular panel may be formed that has superior insulating or light-blocking capabilities when compared to a single-layered honeycomb panel, but takes up approximately the same volume. This characteristic feature could also be achieved by using multiple sheets of material to replace a single sheet in the above embodiments. For example, in the fourth embodiment (FIGS. 10–12), the second strip of material 50 could be cut along its first portion 24', between adhesive beads 60 and 62, into two separate sheets of material. One resulting separate sheet could be affixed to the first strip of material 48 by adhesive beads 60 and 64, and the other resulting sheet could be affixed to the first strip of material 48 by adhesive beads 62 and 66. It is intended that the resulting embodiments, though not specifically depicted and described herein, would fall within the scope of the appended claims.

Another example of an embodiment intended to be covered by the appended claims is formed by slightly modifying the first embodiment (FIGS. 1–3). For example, a longitudinal cut could be made in the first portion 24' of the exterior tubular cell just to the right of adhesive bead 38 in FIG. 1. Then, the remaining part of first portion 24' adjacent the fourth subordinate crease 36, 36', could be affixed to the first free-end portion 22. Although each resulting embedded tubular cell 12 would no longer comprise a single strip of material 14, the resulting embedded tubular cell would resemble the first embodiment depicted and described above, with a multi-layered front side. The primary difference being that it would comprise two sheets of material rather than one.

If the multi-layer embedded tubular cell units 12 are pleated or creased as shown in the above embodiments, then each embedded tubular cell unit 12 of the resulting honeycomb insulating panel 10 will have superior pleat or crease retaining properties since more layers of material are supporting the weight of the honeycomb insulating panel 10. It will be appreciated, however, that although a pleat or crease may be preferred, it is not necessary; and the scope of the invention should be interpreted to incorporate uncreased structures and partially creased structures. It will also be appreciated that while a hexagonal structure is shown, any shape of structure is contemplated.

Although the honeycomb panel 10 depicted in FIGS. 2, 3, 5, 6, 8, 9, 11, 12, 13, 15, 16, 18, and 19 is oriented such that the embedded tubular cell units 12 extend horizontally (i.e., have their longitudinal axes extending horizontally), the honeycomb panel could be hung such that the embedded tubular cells were oriented vertically without departing from the scope of this invention. In a vertical configuration, the honeycomb panel 10 would expand and contract horizontally rather than vertically.

It is intended, therefore, that all matter contained in the above description and shown in the accompanying drawings shall be interpreted as illustrative only and not limiting.

We claim:

1. An expandable and contractible honeycomb panel comprising a plurality of adjacent, embedded tubular cell units, each embedded tubular cell unit comprising an interior tubular cell inside an exterior tubular cell, said embedded tubular cell units being affixed together one on top of another, each of said embedded tubular cell units having a front side and a rear side, and each of said embedded tubular cell units being constructed of at least one strip of foldable and creasable material, and wherein at least one of said front side and said rear side of each of said embedded tubular cell units comprises multiple layers of said material.

2. The honeycomb panel of claim 1, wherein said at least one strip of foldable and creasable material is selected from the group consisting of plastic, and polyester, and a thin film material.

3. The honeycomb panel of claim 1, wherein each embedded tubular cell unit further comprises at least one intermediate tubular cell between said interior tubular cell and said exterior tubular cell.

4. The honeycomb panel of claim 1, wherein, for each embedded tubular cell unit, a single strip of material is folded inside itself to form said at least one multiple-layer side.

5. The honeycomb panel of claim 4, wherein said front side of each embedded tubular cell unit comprises multiple layers of said material, and wherein said interior tubular cell comprises a first portion having an outer surface, and a second portion having an outer surface, and wherein said exterior tubular cell comprises a first portion having an inner surface, and a second portion having an inner surface, and further wherein said outer surface of said first portion of said interior tubular cell is affixed to said inner surface of said first portion of said exterior tubular cell, and still further wherein said outer surface of said second portion of said interior tubular cell is affixed to said inner surface of said second portion of said exterior tubular cell.

6. The honeycomb panel of claim 5 wherein adhesive is used to affix said plurality of adjacent, embedded tubular cell units together one on top of another, and wherein adhesive is used to affix said outer surface of said first portion of said interior tubular cell to said inner surface of said first portion of said exterior tubular cell, and further wherein adhesive is used to affix said outer surface of said second portion of said interior tubular cell to said inner surface of said second portion of said exterior tubular cell.

7. The honeycomb panel of claim 3, wherein, for each embedded tubular cell unit, a single strip of material is folded inside itself to form said at least one multiple-layer side, and wherein said interior cell comprises a first portion having an outer surface and a second portion having an outer surface, and wherein said intermediate tubular cell comprises a first 5 portion having an inner surface and a second portion having an inner surface, and further wherein said outer surface of said first portion of said interior tubular cell is affixed to said inner surface of said first portion of said intermediate tubular cell, and still further wherein said outer surface of said second portion of said interior tubular cell is affixed to said inner surface of said second portion of said intermediate tubular cell.

8. The honeycomb panel of claim 7 wherein adhesive is used to affix said plurality of adjacent, embedded tubular cell units together one on top of another, and wherein adhesive is used to affix said outer surface of said first portion of said interior tubular cell to said inner surface of said first portion of said intermediate tubular cell, and further wherein adhesive is used to affix said outer surface of said second portion of said interior tubular cell to said inner surface of said second portion of said intermediate tubular cell.

9. The honeycomb panel of claim 5, wherein said material further comprises a first free-end portion having an outer surface, and wherein said second portion of said interior tubular cell further comprises an inner surface, and wherein said outer surface of said first free-end portion is affixed to said inner surface of said second portion of said interior tubular cell.

10. The honeycomb panel of claim 1, wherein, for each said embedded tubular cell unit, a plurality of strips of material are folded one inside another to form said at least one multiple-layer side.

11. The honeycomb panel of claim 10, wherein each embedded tubular cell unit further comprises at least one intermediate tubular cell between said interior tubular cell and said exterior tubular cell.

12. The honeycomb panel of claim 10 or 11, wherein each said embedded tubular cell unit comprises a family of neighboring tubular cells arranged one inside another, said family including members comprising said exterior tubular cell and said interior tubular cell, wherein each member of said family of neighboring tubular cells comprises a front second portion having an inside edge, a rear second portion having an inside edge, and a first portion having a front side and a rear side, and wherein, for each member of said family of neighboring tubular cells, said front second portion is folded partially over said front side of said first portion, and said rear second portion is folded partially over said rear side of said first portion, such that said respective inside edges of said front and rear second portions approach but do not overlap each other, and further wherein permanently set folds exist between said first portion and said inside edges of said front and rear second portions separating said respective front and rear second portions from said first portion in a manner biasing said second portions toward said first portion, and wherein each member of said family of neighboring tubular cells is affixed to at least one next neighboring member of said family.

13. An expandable and contractible honeycomb panel comprising a plurality of adjacent, embedded tubular cell units affixed together one on top of another, each embedded tubular cell unit comprising a family of neighboring tubular cells arranged one inside another, said family including members comprising an exterior tubular cell and an interior tubular cell, wherein each member of said family of neighboring tubular cells comprises a first portion having a front side and a rear side, a front second portion having a first inside edge and being folded partially over said front side of said first portion, a rear second portion having a second inside edge and being folded partially over said rear side of said first portion, in such a manner that said first inside edge of said front second portion and said second inside edge of said rear second portion approach but do not overlap each other, and permanently set folds between said first portion and said respective inside edges of said front and rear second portions separating said respective second portions and said first portion in a manner biasing said second portions toward said first portion, and wherein each member of said family of neighboring tubular cells is affixed to a next neighboring member of said family.

14. The expandable and contractible honeycomb panel of claim 13 wherein each member of said family of neighboring tubular cells is arranged such that said first portion of each neighboring family member is affixed to said first portion of a next neighboring family member.

15. The expandable and contractible honeycomb panel of claim 13, wherein each member of said family of neighboring tubular cells is arranged such that said first portion of each neighboring family member is affixed to said second portions of a next neighboring family member.

16. The expandable and contractible honeycomb panel of claim 14 or 15, wherein each said family of neighboring tubular cells consists of said interior tubular cell and said exterior tubular cell.

17. The expandable and contractible honeycomb panel of claim 14 or 15, wherein each said family of neighboring tubular cells consists of three tubular cells.

18. The expandable and contractible honeycomb panel of claim 13, wherein said first portion of each said exterior tubular cell further comprises an outer surface, and wherein said front and rear second portions of each said exterior tubular cell each further comprises an outer surface, and wherein said exterior tubular cells of adjacent, embedded tubular cell units are affixed together by adhering an outer surface of said front and rear second portions of an adjacent, embedded tubular cell unit to an outer surface of said first portion of a next adjacent, embedded tubular cell unit.

19. The expandable and contractible honeycomb panel of claim 18, wherein adhesive is applied to said outer surface of said front and rear second portions adjacent said inside edges thereof.

* * * * *

UNITED STATES PATENT AND TRADEMARK OFFICE

CERTIFICATE OF CORRECTION

PATENT NO. : 5,974,763
DATED : November 2, 1999
INVENTOR(S) : Colson et al.

It is certified that error appears in the above-identified patent and that said Letters Patent is hereby corrected as shown below:

Column 10,
Line 12, delete "5".

Signed and Sealed this

Twenty-sixth Day of February, 2002

*Attest:*

*Attesting Officer*

JAMES E. ROGAN
*Director of the United States Patent and Trademark Office*